US006745597B2

(12) United States Patent
Tang et al.

(10) Patent No.: US 6,745,597 B2
(45) Date of Patent: Jun. 8, 2004

(54) POSITIVE FEEDING METHOD AND APPARATUS OF AN ENCODER

(75) Inventors: Chien-Fa Tang, Tu Cheng (TW); Chin-Huang Chiang, Tu Cheng (TW)

(73) Assignee: China Textile Institute, Taipei Shien (TW)

( * ) Notice: Subject to any disclaimer, the term of this patent is extended or adjusted under 35 U.S.C. 154(b) by 177 days.

(21) Appl. No.: 10/029,982

(22) Filed: Dec. 31, 2001

(65) Prior Publication Data

US 2003/0122019 A1 Jul. 3, 2003

(51) Int. Cl.[7] ..... D04B 15/48

(52) U.S. Cl. ..... 66/132 R

(58) Field of Search ..... 66/131, 132 R, 66/125 R, 132 T; 242/365.6, 157 R

(56) References Cited

U.S. PATENT DOCUMENTS 5,369,966 A * 12/1994 Morita et al. ..... 66/132 R
6,102,320 A * 8/2000 Chen ..... 242/365.6
6,202,450 B1 * 3/2001 Chen ..... 66/132 R

FOREIGN PATENT DOCUMENTS

EP 0894884 * 5/1999 ..... 66/132 R

* cited by examiner

*Primary Examiner*—Danny Worrell
(74) *Attorney, Agent, or Firm*—Rosenberg, Klein & Lee

(57) ABSTRACT

A positive or active yarn feeding method and apparatus is provided which synchronizes the feeding of textile materials and provides encoding. The device includes a motor connected to an axle, on which a coupling spins the wheel and activates the belt. The motor receives signals from the positive or active feeding controller to adjust its speed. Connected with the main motor, the encoder outputs reference signals that incorporate production data derived with computers.

7 Claims, 3 Drawing Sheets

POSITIVE FEEDING METHOD AND APPARATUS OF AN ENCODER

BACKGROUND OF THE INVENTION

This invention refers to a digital feeding speed controlling encoder for a circular knitting machine. Generally, the feeding part of an encoder is divided into passive and positive or active forms, of which this invention is mainly concerned with the positive or active form. The positive or active mechanism feeds automatically a certain length of yarn into the knitting section. It is commonly adopted by a conventional device on the main structure called a quality pulley, due to its being able to adjust the yarn tension.

A conventional encoder adjusts the notches of the quality pulley disc to control the density of the textile from different materials. In addition to mobilizing the knitting pins, the main motor of an encoder, by way of a gear-transmission to activate the belt around the pulley disc, surveys several feeding devices and hence progressively feeds the yarn into the knitting pins to increase productivity. Since accelerating the belt speeds up the feeding, the pulley disc operation control turns out primary. Nevertheless, lacking such numerical control, conventional encoders must rely on manual operation to control the textile density by employing skilled workers to stop or adjust the machines whenever necessary. In this case, in the production process, the machines have to be stopped in order to adjust the pulley disc, i.e., using a tool to loosen the bolt of the pulley disc, rotating the disc clockwise or counterclockwise to change the diameter of the segments in the disc, then re-starting and working the connected belt to make the encoder feed the yarn.

As shown in FIG. 1, the quality pulley disc (1) described above is comprised of twelve trapezoidal cubic segments (11) that are assembled in a circular arrangement. The segments are pressed together tightly by two round discs (12), (13). Between the upper disc (12) and the segments, there are twelve slots running outwards from the center. On the other side, the disc is closely connected with the spiral slots of the lower disc (13). When turning the upper disc (12) and leaving the lower disc (13) still, the segments, carried by the upper disc (12), will expand or contract according to a change in the perimeter of the circular quality pulley disc and also change the speed of the belt accordingly. Since the length of the belt is constant and the belt itself is non-extensible, a belt-tension-controlling device is needed to avoid the sliding difference phenomenon, which causes the problem of mal-distributed or uneven textile density. Therefore, the conventional encoders take a lot of time to stop and check repeatedly whenever the knitting density is not stable. For example, the conventional encoder, as shown in European patent EP00894884 has to separately adjust the tension of the belt to sustain even feeding. To improve the shortcoming of conventional encoders, this invention provides a better feeding method and apparatus.

This invention, primarily, provides a precise digitally controlled feeding device to replace the conventional speed control and belt-tension control to thereby obviate the need for manually altering the pulley disc and belt tension and certainly decreases the production standby time.

Now the features and advantages of the invention will be described in detail with reference to the accompanying drawings.

BRIEF DESCRIPTION OF THE INVENTION

DETAILED DESCRIPTION OF THE INVENTION

Figure 1:
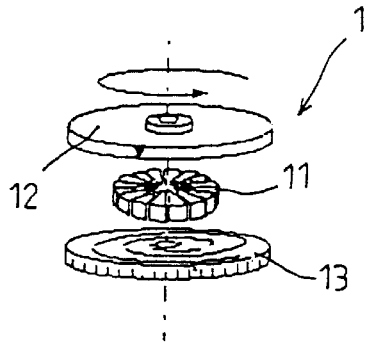
FIG. 1 (prior art)
FIG. 1 is a perspective view showing a conventional quality pulley disc.
Figure 2:
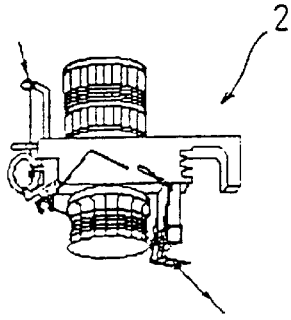
FIG. 2 (prior art)
FIG. 2 is a perspective view showing a conventional yarn storage feeding device.
Figure 3:
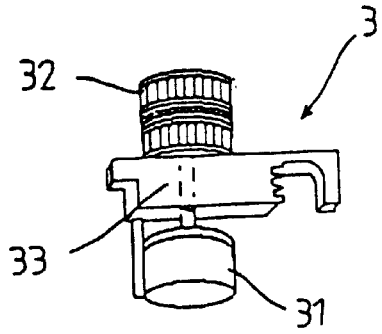
FIG. 3 is a perspective view showing a positive feeding device according to the present invention.
Figure 4:
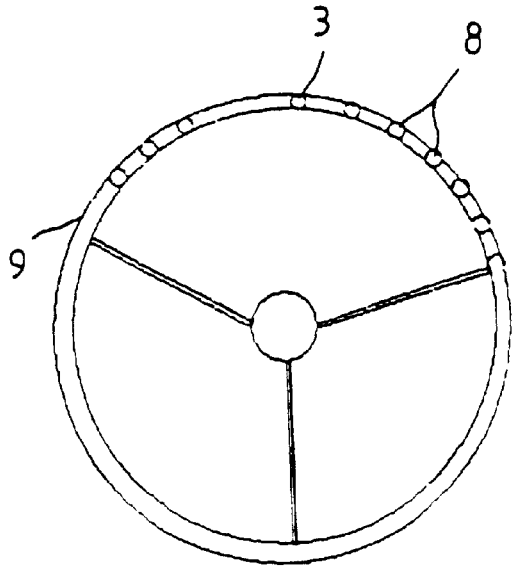
FIG. 4 is a top plan view showing a general outline of an encoder according to the present invention.
Figure 5:
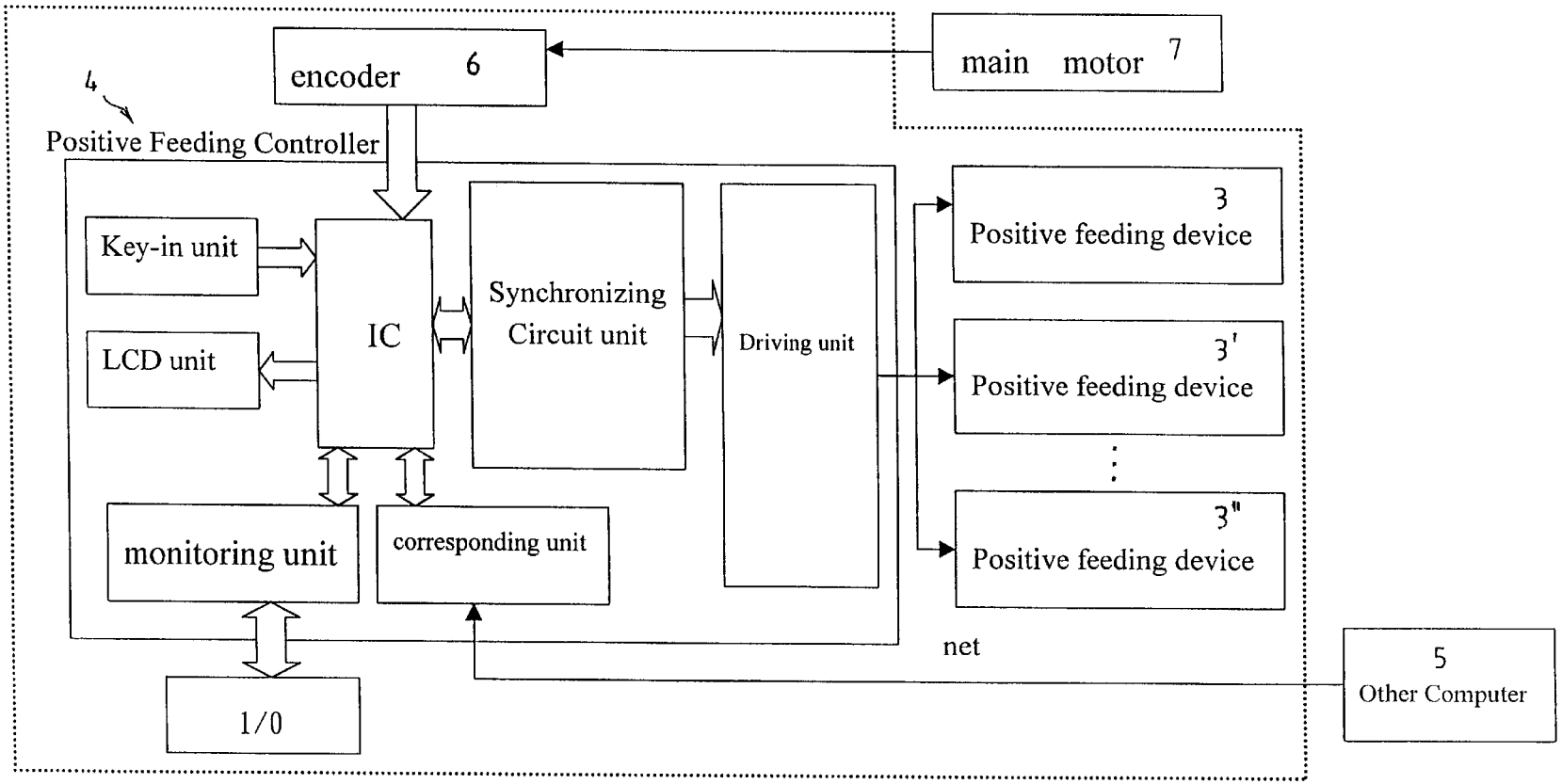
FIG. 5 is a system chart showing the controlling process according to the present invention.

Referring to FIGS. 3 to 5, this invention deals with the improvement of the feeding speed control of the conventional encoders. The positive or active feeding device (3) includes a motor (31), connected with a coupling (33) and a wheel (32) that work in combination with a coupling (33) to drive the belt. The positive or active controller (4) uses an internal circuit as the power to drive the motor that connects the positive or active feeding devices (3) and the other computer (5). The encoder (6) connected with the main motor (7) inputs reference signals into the positive or active feeding controller (4). The positive or active feeding controller (4) is composed of a synchronizing circuit unit, a programming IC, a corresponding unit, a multi-motor-transistor-driving unit, a monitoring unit, a key-in unit and an LCD unit. It can exchange production data with external computers through the corresponding unit.

As described in the above structure, the positive or active feeding method uses the positive or active feeding device (3) composed of a motor (31) connected with a wheel (32), and the belt (9) around the wheel driving the yarn storage feeding device (8) to feed the yarn into the weaving knitting section. The encoder (6) on the axle of the main motor generates data that varies with the driving speed and inputs that data into the positive or active feeding controller (4). The connected computers compute the translation of the textile density into speed signals, whereby the positive or active feeding controller (4) receives the computed result and conveys the feeding signals to drive the motors (31) in the positive or active feedings devices, free from the inconvenience and waste caused by manually changing the diameter of the pulley disc and the tension of the belt. The main motor can be either a stepped-motor or a servomotor.

The encoder (6) mentioned above can detect the speed of the knitting pins and derive the related density parameter. The programming IC processes the parameter into digitized signals, which are a function of the pulses of the encoder and output in from the synchronizing circuit unit at least a set of the main motor's ratio binding driving signals that eventually drive at least one positive or active feeding device.

Furthermore, this invention uses the rated synchronizing operation of the positive or active feeding device and the encoder to make the feeding speed and the tension of the yarn constant. It provides, as well, the instant digital correction and storage of the textile density. All in all, the flexible control of density may provide an excellent mixture of different textile patterns and be able to respond productively to the ever-changing and novel designs in fashion.

One of the major characteristics of this invention is that its system can be added to any encoder. The positive or active feeding device is easy to install and put close to the yarn storage feeding device. Up to six positive or active feeding devices can be set up to satisfy multiple feeding speeds.

The objectives of this invention are to raise productivity, to shorten intervals of work stoppage when the textile density is changed, to use a digital automatic feeding method to maintain even tension of the yams, and to create versatility of the textile density.

The above description of this invention does not confine its domain. Many refinements can be made by those skilled in the art without departing from the principles and spirit of this invention.

What is claimed is:

1. An active feeding apparatus of an encoder for a knitting machine comprising:

(a) an active feeding device, (b) a main motor with a coupling at a first side and a wheel mobilizing a belt at a second side;

(c) an active feeding controller to receive a signal of a yarn feeding speed and a main motor speed, and then output an active feeding speed signal; and, (d) an encoder connected with the axle of the main motor to output a speed reference signal.

2. An active feeding method of an encoder for a knitting machine, comprising the steps of:

(a) using an active feeding device composed of a motor activating wheel drivingly connected to a belt that turns a yarn storage feeding device which feeds a yarn composition into a knitting section;

(b) using an encoder on an axle of a main motor to produce a signal that varies with a driving speed and is communicated to and received by a motor controller whose function is to compute a texture density and thereby derive a yarn feeding speed signal; and (c) synchronizing the main motor with said knitting machine which is devoid of a mechanism to manipulate a perimeter of a pulley disc and adjust a tension of said belt.

3. The active feeding apparatus of an encoder as claimed in claim 1, wherein the active feeding apparatus whose active feeding controller receives a plurality of data from the encoder and processes said plurality of data through an internal synchronizing circuit unit, a programming IC, a corresponding unit, a multi-motor-driving unit, a monitoring unit, a key-in unit and an LCD unit, wherein said corresponding unit communicatively connects with at least one other computer for an exchange of a production data set.

4. The active feeding apparatus of an encoder as claimed in claim 1, wherein the active feeding device has a plurality of motor-wheel sets that turn at a plurality of speeds.

5. The active feeding apparatus of an encoder as claimed in claim 1, wherein the active feeding apparatus with a main motor that is one of a stepped-motor or a servo-motor and uses the encoder to control a speed thereof.

6. The active feeding apparatus of an encoder as claimed in claim 1, wherein the active feeding apparatus whose active feeding controller computes a textile density into feeding data and outputs from a plurality of synchronizing signals; whereby a plurality of active feeding devices are synchronized with the axle of the main motor.

7. The active feeding method of an encoder as recited in claim 2, wherein the active feeding method produces a textile with a pre-determined density by a digital control of said textile density.

* * * * *